US005884255A

United States Patent [19]

Cox

[11] Patent Number: 5,884,255

[45] Date of Patent: Mar. 16, 1999

[54] SPEECH DETECTION SYSTEM EMPLOYING MULTIPLE DETERMINANTS

[75] Inventor: Geoffrey Marshall Cox, Jefferson, Md.

[73] Assignee: Coherent Communications Systems Corp., Leesburg, Va.

[21] Appl. No.: 678,363

[22] Filed: Jul. 16, 1996

[51] Int. Cl.[6] ..... G10L 5/06; G10L 9/00

[52] U.S. Cl. ..... 704/233; 704/236

[58] Field of Search ..... 395/2.34, 2.35, 395/2.36, 2.23, 2.24, 2.42, 2.45

[56] References Cited

U.S. PATENT DOCUMENTS

| | | |
|---|---|---|
| 3,832,496 | 8/1974 | Clark . |
| 4,028,496 | 6/1977 | LaMarche et al. . |
| 4,052,568 | 10/1977 | Jankowski . |
| 4,061,878 | 12/1977 | Adoul et al. . |
| 4,187,396 | 2/1980 | Luhowy . |
| 4,243,837 | 1/1981 | Bertholon . |
| 4,277,645 | 7/1981 | May, Jr. . |
| 4,281,218 | 7/1981 | Chuang et al. . |
| 4,351,983 | 9/1982 | Crouse et al. . |
| 4,357,491 | 11/1982 | Daaboul et al. . |
| 4,382,164 | 5/1983 | May, Jr. . |
| 4,410,763 | 10/1983 | Strawczynski et al. . |
| 4,667,065 | 5/1987 | Bangerter . |
| 4,700,392 | 10/1987 | Kato et al. . |
| 4,764,966 | 8/1988 | Einkauf et al. . |
| 4,975,657 | 12/1990 | Eastmond . |
| 5,152,007 | 9/1992 | Uribe . |
| 5,323,337 | 6/1994 | Wilson et al. . |

*Primary Examiner*—David R. Hudspeth
*Assistant Examiner*—Robert Louis Sax
*Attorney, Agent, or Firm*—Dann, Dorfman, Herrell & Skillman, P.C.

[57] ABSTRACT

A speech detection system is provided with multiple speech detector sub-systems. The speech detection sub-systems employ distinct statistical methods for determining whether speech is present in an electronic communication signal received at an output terminal. For example, a first speech detection sub-system employs moving average peak signal filter, a second speech detection sub-system employing a moving average noise filter, and a third speech detection sub-system employs a variance filter. Signals from each of the filters are compared with respective threshold values, and the threshold values are provided to speech determination logic for making an aggregate speech detection decision. The speech detection system is useful for telephonic automatic gain control.

25 Claims, 1 Drawing Sheet

SPEECH DETECTION SYSTEM EMPLOYING MULTIPLE DETERMINANTS

FIELD OF THE INVENTION

The present invention relates to a process and apparatus for determining whether an electronic communication signal is composed primarily of speech or noise. More particularly, the present invention relates to a speech detection system that continuously classifies a signal as speech or noise by combining the individual results of a plurality of statistical determinations conducted in parallel on the communication signal.

BACKGROUND OF THE INVENTION

Automatic gain control (AGC) circuits are used within communication systems, such as telephonic communication systems, in order to maintain transmitted speech signals at comfortably audible levels. In order to maintain a specified average or peak level of speech signals, while minimizing noise content, automatic gain control circuits use a speech detector for discriminating between speech and noise signals. Typically, a speech detector evaluates a single statistical property of the transmitted signal, compares the statistical property value with a predetermined reference and provides a logical output signal indicating the presence or absence of speech in the transmitted signal. The AGC circuit responds to the logical output signal by adjusting the applied gain depending on whether a logical output signal indicates the presence of speech.

One problem with traditional speech detectors is that reliance upon a single statistical determination renders such speech detectors vulnerable to making false determinations when evaluating noise to noise signals that possess the requisite statistical property at a level sufficient to indicate speech detection. Another problem is that the production of a single logical output obscures the degree of confidence with which the presence of speech was determined by the speech detector. It would be desirable to provide a speech detector that utilizes more than a single statistical criterion in order to determine the presence of speech in a transmitted telephone signal. It would further be desirable to provide a speech detector that produces a detection signal from which the degree of confidence in the determination can be taken into account in adjusting the gain.

SUMMARY

According to one aspect of the present invention, a speech detector for a telephone AGC system comprises separate speech detection mechanisms for making independent determinations of the presence of speech in a signal. Each of the speech detection mechanisms produces a detection signal, and the individual detection signals are combined to produce an aggregate detection signal for indicating the presence of speech in a transmitted signal.

According to another aspect of the invention, the individual detection signals indicate a degree of confidence in each speech detector's determination of the presence or absence of speech in the transmitted signal.

DETAILED DESCRIPTION

Figure 1:
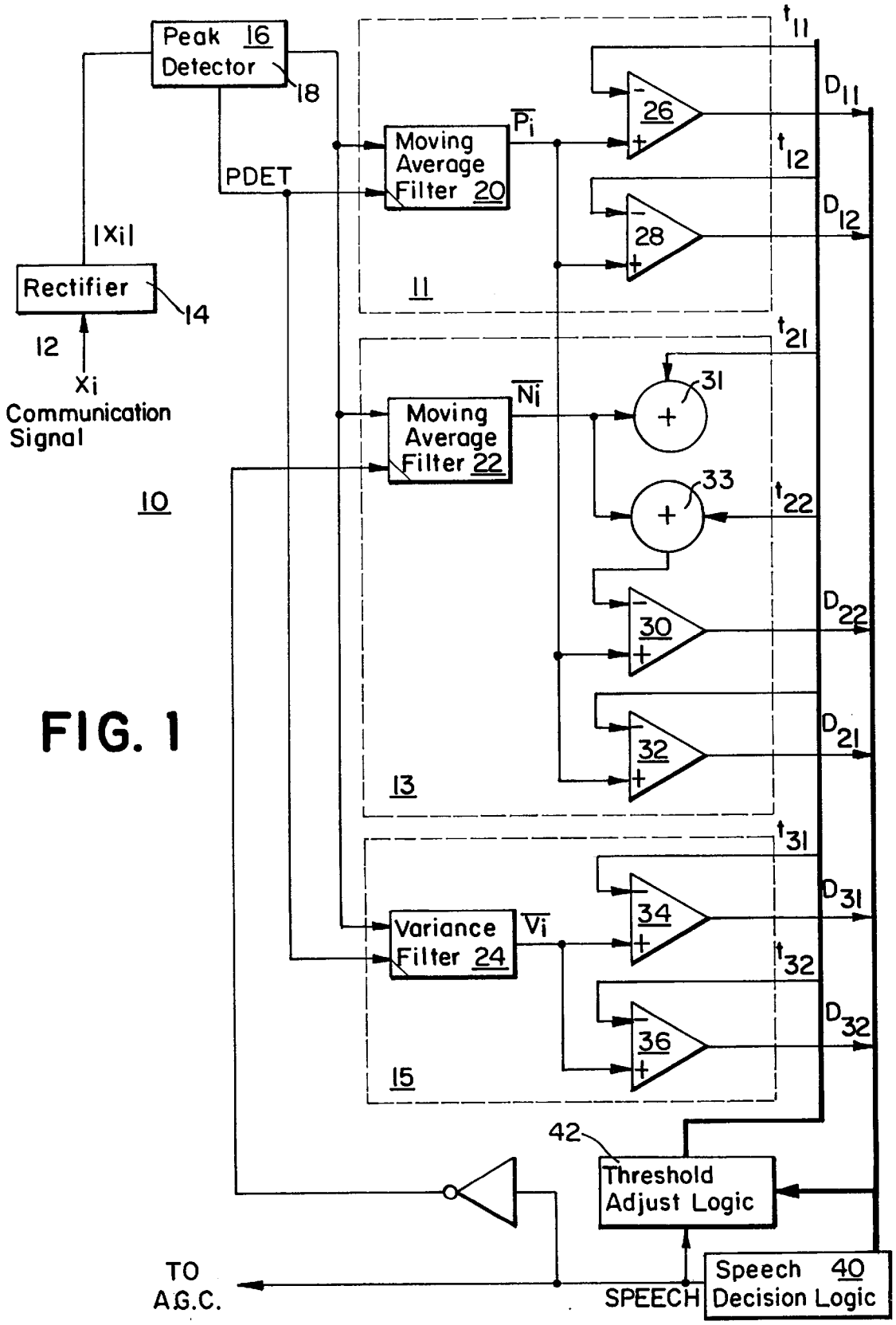
FIG. 1 is a functional block diagram of a speech detector according to the present invention.

Referring now to FIG. 1, there is shown a functional block diagram of a speech detector 10 of the present invention. As will be appreciated, the physical implementation of the speech detector may be realized by analog circuits, digital circuits, an appropriately-programmed general-purpose digital signal processor (DSP), or a hybrid of such types of circuitry as desired. In the preferred embodiment, a digital signal processor is programmed to accomplish the various functions shown in FIG. 1 as functional blocks and described herein.

A communication signal is provided to input terminal 12 of the speech detector 10. The communication signal is typically a voice band signal, such as a standard 300 Hz to 3500 Hz telephone signal. Alternatively, the communication signal may comprise a subband portion of a voice band signal in, for example, applications where it is desirable to make speech/noise determinations within individual subband portions of a communication channel.

The communication signal is shown in FIG. 1 to be represented by a sequence of digital values, $x_i$. The communication signal is first converted to a nonzero-mean signal for ease in identifying positive and negative peak values of the signal $x_i$. Such a nonzero-mean signal is produced as an absolute value signal, $|x_i|$, by a rectifier 14.

The absolute value signal, $|x_i|$, is provided by the rectifier 14 to a peak detector 16. The peak detector 16 is arranged to detect local maxima in the absolute value signal. When a local maximum is detected, the peak detector asserts a detection signal, PDET, indicating that a peak value has been detected in the communication signal. Simultaneously, the detected peak value, $p_i$, is provided by the peak detector 16 to an output register or at terminal 18. In a DSP embodiment, the detection signal PDET may be implemented by a branch instruction in a peak detection loop. If no peak is detected in connection with the input signal, then the peak detection loop continues to execute until a peak value is detected.

The detected peak value $p_i$ is provided as an input to three speech detectors, including a moving average peak signal detector 11, a moving average peak noise detector 13, and a moving variance detector 15. The speech detectors 11, 13 and 15 each comprise a statistical filter for producing respective statistical values relating to the sequence of peak values $p_i$. In the preferred embodiment, detector 11 includes a moving average peak filter 20 for generating a moving average of the peak signal values; detector 13 includes a moving average noise filter 22 for producing a moving average of the peak signal during intervals when the speech detector 10 determines that the input signal is predominately noise; and moving variance detector 15 includes a variance filter 24 for producing an output signal $\bar{v}_i$ representing the variance of the peak signal $p_i$.

Within the moving average peak signal detector 11, the moving average peak filter 20 receives the peak detection signal PDET at an enable terminal, and in response, updates a moving average output value $\bar{p}_i$ according to the averaging formula:

$$\bar{p}_i = \frac{1}{m} p_i + \frac{m-1}{m} \bar{p}_{i-1}$$

where m>1. The averaging constant, m, determines the weight of each peak value upon the moving average, and hence affects the responsiveness and decay time of the moving average $\bar{p}_i$. A first determination of whether the communication signal consists primarily of speech or noise is made by comparing the present value of the moving average signal $\bar{p}_i$ to a predetermined threshold value. The assumption behind such a comparison is that high average peak values are more likely to be generated during intervals of speech than during intervals of noise.

Preferably, the moving average $\bar{p}_i$ is compared with more than one threshold value, in order to produce an output signal that conveys more information than a simple binary speech/non-speech output signal. In the embodiment shown, the moving average signal $\bar{p}_i$ is compared by comparators 26 and 28 with threshold values $t_{11}$ and $t_{12}$ where $t_{11}<t_{12}$, to produce one of three output combinations of determinants $D_{11}$ and $D_{12}$:

(1) $\bar{p}_i \leqq t_{11}$, where $D_{11}=0$ and $D_{12}=0$ (2) $t_{11}<\bar{p}_i \leqq t_{12}$, where $D_{11}=1$ and $D_{12}=0$ (3) $\bar{p}_i>t_{12}$, where $D_{11}=1$ and $D_{12}=1$ Condition (1) is interpreted as being indicative of noise, condition (2) is indicative of an indeterminate condition, and condition (3) is indicative of speech. In a traditional speech detection system, which uses only a moving average peak determination, the indeterminate condition would be of little practical value. However, because the moving average peak determination is aggregated with other determinations, the degree of confidence in the detection of speech by any one detector is a useful indicator of the weight to be accorded to that detector's contribution to the overall speech determination. A multiple-valued, or soft, determinant can be produced by assigning values of 0, 1, or 2 to the respective output conditions in accordance with the algebraic sum of the binary determinants $D_{11}$ and $D_{12}$.

Within the moving average peak noise detector 13, the sequence of peak values $\bar{p}_i$ is provided to moving average noise filter 22. Moving average filter 22 is arranged to provide a moving average of the peak values according to a similar formula as discussed in connection with moving average peak filter 20. However, moving average filter 22 is connected to be enabled by the logical inverse of the speech detection signal, SPEECH. Hence, filter 22 updates its moving average only when the speech detector 10 determines that the communication signal consists primarily of noise, and holds the present output value when the communication signal consists primarily of speech. The moving average noise filter 22 provides a sequence of average peak noise values $\bar{n}_i$. A second speech/non-speech determination can then be made on the basis of whether the present average peak value $\bar{p}_i$ exceeds the noise average $\bar{n}_i$ by a predetermined margin.

Preferably, as in the moving average peak signal detector 11 discussed above, a soft determinant is produced in connection with the noise average by employing multiple threshold values, $t_{21}$ and $t_{22}$ to define at least three output conditions according to binary determinants $D_{21}$ and $D_{22}$ defined as:

(1) $\bar{p}_i \leqq \bar{n}_i+t_{21}$, where $D_{21}=0$ and $D_{22}=0$ (2) $\bar{n}_i+t_{21}<\bar{p}_i \leqq \bar{n}_i+t_2$ where $D_{21}=1$ and $D_{22}=0$ (3) $\bar{p}_i>\bar{n}_i+t_{22}$, where $D_{21}=1$ and $D_{22}=1$ The components for producing the binary determinants $D_{21}$ and $D_{22}$ are shown in FIG. 1, including summing junctions 31 and 32 for adding the respective threshold values to the noise average signal $\bar{n}_i$, and comparators 30 and 32 for comparing the resulting sums with the average peak signal $\bar{p}_i$.

The variance detector 15, produces a third soft determinant by providing the sequence of peak values $\bar{p}_i$ to a moving variance filter 24. The moving variance filter 24 computes an approximation of the variance $\bar{v}_i$ of the peak signal $\bar{p}_i$ in accordance with the formula:

$$\bar{v}_i = \frac{1}{n}\ (p_i - \bar{p}_i)^2 + \frac{n-1}{n}\ \bar{v}_{i-1}$$

where the weighting factor, n>1, determines the response time of the filter 24. A speech/noise determination is made on the basis of whether the variance signal $\bar{v}_i$ is below a predetermined threshold. In general, the variance of a pure noise signal is lower than the variance of a pure speech signal. Preferably, a soft determination is made by comparing the variance signal $\bar{v}_i$ with at least two thresholds, $t_{31}$ and $t_{32}$, to define at least three conditions as:

(1) $\bar{v}_i \leqq t_{31}$, where $D_{31}=0$ and $D_{32}=0$ (2) $t_{31}<\bar{v}_i \leqq t_{32}$, where $D_{31}=1$ and $D_{32}=0$, and (3) $\bar{v}_i>t_{32}$, where $D_{31}=1$ and $D_{32}=1$ In an embodiment where the speech detectors produce a binary speech/non-speech decision, an overall speech detection output signal, SPEECH, can be produced on the basis of whether a majority of the speech detectors presently indicates speech or non-speech. Such a strategy will always produce a defined result for an odd number of speech detectors. For an even number of speech detectors, the overall speech detection output signal can be maintained in its previous condition whenever the results are evenly divided among the individual detectors.

In an embodiment where each of the speech detectors produces a multi-valued or soft determinant, the overall speech detection output can be determined on the basis of an aggregate of the soft determinant values. For example, the binary determinant values $D_{jk}$ from the comparators 26, 28, 30, 32, 34 and 36 are provided to speech decision logic 40. Speech decision logic 40 is configured to produce the aggregate determinant value as, for example, the algebraic sum of the binary determinants ($\Sigma D_{jk}$) or of the soft determinants computed in the manner discussed above. From the aggregate determinant value the speech detection logic then produces a logical output signal, SPEECH, according to the following table:

| $\Sigma D_{jk}$ | SPEECH |
|---|---|
| 0 | 0 |
| 1 | 0 |
| 2 | 0 |
| 3 | $SPEECH_{i-1}$ |
| 4 | 1 |
| 5 | 1 |
| 6 | 1 |

When $\Sigma D_{jk}<3$, then speech decision logic 40 determines that the communication signal consists primarily of noise, and SPEECH is not asserted. When $\Sigma D_{jk}>3$, then speech decision logic 40 determines that the communication signal consists primarily of speech, and SPEECH is asserted. When $\Sigma D_{jk}=3$, then SPEECH is maintained at its previous value, since the aggregate determinant, $\Sigma D_{jk}$,is not strongly indicative of either speech or noise.

The individual determinants $D_{jk}$ are also provided to threshold adjust logic 42, which is configured for dynamically adjusting the threshold values $t_{jk}$ employed within the individual speech detectors 11, 13 and 15. Dynamic threshold adjustment is desirable to enable the speech detector to adapt to time-variant properties of a communication channel or of a signal within a communication channel. Additionally, dynamic threshold adjustment is desirable for employing the speech detector 10 in a multiplex communication system where rapid adaptation to any of several communication channels is desirable.

It may occur that the output condition of an individual speech detector conflicts with the overall determination made by speech decision logic 40. Such a conflict can occur due to differences among the response times of the individual detectors, to changing signal conditions or to idiosyncratic statistical properties of the communication signal that favor a false determination from a particular detector. In order to correct for false determinations, one or more of the detection threshold values within an individual detector is adjusted incrementally within predefined limits, and during time intervals at least as long as the response time of the filter associated with that detector. Preferably such adjustment is carried out to an extent sufficient to render the output condition of the conflicting detector to be indeterminate, because "forcing" any of the individual detectors to agree with the overall determination would reduce the advantages obtained by employing a multiple detection scheme. When multiple thresholding is employed within an individual detector, as in the preferred embodiment, each threshold value is adjusted with reference to absolute limits and to limits that are relative to the other threshold value(s). That arrangement prevents the multiple threshold values from diverging to the extent that a determinate output condition is rendered unlikely or impossible.

For example, if the logical output signal SPEECH is not asserted (indicating an overall noise determination), and the soft determinant from the moving average signal detector 11 is indicative of speech ($D_{11}+D_{12}=1+1=2$), then the upper threshold $t_{12}$ is incrementally increased by the threshold adjust logic 42 until the soft determinant from the moving average detector is indicative of an indeterminate condition ($D_{11}+D_{12}=1+0=1$). Since the threshold adjustment is performed incrementally, and preferably not more rapidly than the adaptation time of the moving average filter 20, then it may occur that a variation of the communication signal resolves the conflict (either by causing a change in SPEECH or in the output condition of the moving average signal detector 11), in which case the threshold $t_{12}$ will be maintained at its most recent value whether or not an indeterminate output condition is achieved prior to resolving the conflict.

Similarly, if SPEECH is asserted and the output condition of the moving average signal detector 11 is indicative of noise, then the lower threshold $t_{11}$ is incrementally decreased until the output condition of the moving average detector is indeterminate, or until the conflict is otherwise resolved.

Preferably, upward adjustment of $t_{12}$ is limited to a maximum level below the average level of a speech signal, for example to no more than about 3 dB below the average speech level, SAVG (which may be determined by averaging $|x_i|$ during assertion of SPEECH). Downward adjustment of $t_{11}$ is limited to a minimum, such as about 6 dB above the average noise level, NAVG (which may be determined by averaging $|x_i|$ during non-assertion of SPEECH). Additionally, as either $t_{11}$ or $t_{12}$ is adjusted, then the other threshold may also be adjusted by the same amount in order to desirably maintain a separation between the two thresholds that is commensurate with a predetermined or measured signal-to-noise ratio within the communication signal.

The threshold adjust logic 42 adjusts the thresholds relating to the noise average detector 13 as follows. If SPEECH is non-asserted and the output condition of the noise average detector 13 is indicative of speech ($D_{21}+D_{22}=2$), then $t_{22}$ is increased to drive the noise average detector toward an indeterminate output condition. If SPEECH is asserted and the output condition of the noise average detector 13 is indicative of noise ($D_{21}+D_{22}=2$), then $t_{21}$ is decreased to drive the noise average detector toward an indeterminate output condition. Preferably, $t_{22}$ is limited to a maximum of 2 dB below the difference between the average speech level and the average noise level ($t_{22} \leqq |NAVG-SAVG|$), and $t_{21}$ is maintained about 2 dB above the noise average. However if the signal-to-noise ratio is poor, such as 4 dB or less, then $t_{22}$ and $t_{21}$ may be adjusted over a wider range.

In a similar manner, the threshold adjust logic 42 is configured to drive the variance detector 15 toward an indeterminate condition by adjusting $t_{31}$ and/or $t_{32}$ within appropriate absolute and/or relative limits when the variance detector 15 conflicts with the overall determination indicated by SPEECH.

As noted above, the threshold adjust logic 42 is configured to drive any individual speech detector toward an indeterminate output condition if the detector conflicts with the overall speech determination. Additional improvements in speech detection accuracy can be achieved by configuring the threshold adjust logic 42 to detect whether any individual speech detector produces an indeterminate output condition for a period of time significantly exceeding the response time of its associated filter. Such long indeterminate conditions can indicate that the difference between the corresponding threshold values is undesirably large, thus creating an undesirably large range of indeterminacy. By reference to pre-selected interval limit values, the threshold adjust logic 42 can be configured to detect when an individual speech detector has exceeded such a limit, and to take appropriate action. For example, when an individual speech detector has exceeded its indeterminacy interval limit, then the threshold adjust logic 42 responds by driving the speech detector toward an output condition corresponding to the present condition of SPEECH, by adjusting one or more of the associated threshold values.

Each of the individual detectors may utilize more than two threshold values in order to provide a larger number of gradations in which the aggregate determinant indicates speech, noise, or an indeterminate condition. For example, in an embodiment wherein three threshold levels are employed within each detector, then the aggregate determinant will have nine possible values defined as:

| $\Sigma D_{jk}$ | SPEECH |
|---|---|
| 0 | 0 |
| 1 | 0 |
| 2 | 0 |
| 3 | 0 |
| 4 | $SPEECH_{j-1}$ |
| 5 | $SPEECH_{j-1}$ |
| 6 | 1 |
| 7 | 1 |
| 8 | 1 |
| 9 | 1 |

In such an embodiment, the aggregate determinant may be defined as indicating an indeterminate speech detection condition when $\Sigma D_{jk}=4$ or when $\Sigma D_{jk}=5$. The individual soft determinant values will range between 0 and 3. The larger range of soft determinant values offers additional opportunities for threshold level adjustment by the threshold adjust logic 42. For example, when SPEECH is non-asserted, then any detector having a soft determinant value of 2 or 3 can have its associated threshold levels adjusted to produce a lower-valued soft determinant. Conversely, when SPEECH is asserted, then any detector having a soft determinant value of 0 or 1 can have its associated threshold levels adjusted to produce a higher-valued soft determinant. Additionally, when the aggregate determinant is in an indeterminate speech detection condition, any detector with an extreme soft determinant value (e.g. 0 or 3) can be driven to produce a less extreme determinant value (e.g. 1 or 2).

In another alternative embodiment, the individual logical determinants $D_{jk}$ can be presented to an appropriate register of the speech decision logic 42 as a binary speech detection word $\{D_{31}D_{21}D_{11}D_{32}D_{22}D_{12}\}$. The higher order bits of the binary speech detection word comprise the binary determinants associated with the upper detection thresholds, while the lower order bits of the binary speech detection word comprise the binary determinants associated with the lower detection thresholds. Rather than perform any computational operations, the speech decision logic 40 is configured to retrieve or otherwise produce the SPEECH output condition from an appropriate lookup table or logic array. The threshold adjust logic 42 can be similarly configured to perform adjustment of the detector thresholds in direct response to a predetermined binary speech detection word. Higher accuracy in speech detection can thus be achieved than in embodiments where the specific assertion levels of the binary determinants are merged into an aggregate determinant value. For example, the aggregate determinant value would be 4 for both of the speech detection words 101101 and 001111, yet it may be desirable to define a different logical condition of SPEECH for the respective detection words. By operating the speech decision logic in direct response to defined binary detection words, such a capability is provided.

In a further embodiment employing the binary speech detection word, the speech decision logic 40 is configured to respond to predetermined sequences of speech detection words, in addition to responding to individual speech detection words. Such operation can then compensate appropriately for differing response times of the individual speech detectors. For example, if the moving average filter responds to speech more quickly than the other detectors, and if a predetermined number of successive binary detection words are each 000000, then the speech decision logic 40 responds to 001001 by asserting SPEECH on the assumption that speech has begun, but the other detectors have not had sufficient time to detect the speech. If the speech detector remains at 001001 beyond the response time of one or both of the other detectors, then it may be assumed that the moving average filter has made a false determination, SPEECH may be de-asserted, and the moving average detection thresholds may be appropriately adjusted.

In another embodiment employing binary speech detection words, the speech decision logic 40 receives successive binary speech detection words and continuously computes a vector indicating the rate of change and direction of the successive speech detection words. Such a process avoids the need to store a large number of speech detection words in order to extract temporal data pertaining to the speech detection condition of the individual speech detectors.

The terms and expressions which have been employed herein are used as terms of description and not of limitation. There is no intention in the use of such terms and expressions of excluding any equivalents of the features shown and described or portions thereof. It is recognized, however, that various modifications are possible within the scope and spirit of the invention as claimed.

That which is claimed is:

1. An apparatus for detecting the presence of speech in a communication signal, comprising:

an input terminal for receiving the communication signal;

a first filter connected with the input terminal for providing a first statistical signal representing a first statistical value derived from the communication signal;

first comparison means for comparing the first statistical signal with a first reference signal indicative of the presence of speech in the communication signal, and for producing a first determinant signal indicating a result of the comparison;

a second filter connected with the input terminal for providing a second statistical signal representing a second statistical value derived from the communication signal;

second comparison means for comparing the second statistical signal with a second reference signal indicative of the presence of speech in the communication signal, and for producing a second determinant signal indicating a result of the comparison; and speech decision logic connected for receiving the first and second determinant signals, and configured for combining the first and second determinant signals adding to produce an aggregate determinant signal, for deciding that speech is present in the communication signal on the basis of the aggregate determinant signal, and for providing a logical output signal representing the result of the decision.

2. The apparatus of claim 1 wherein the first and second reference signals each comprise at least two threshold signals, and wherein the first and second comparison means are configured to provide each of said first and second determinant signals as a multi-valued signal having at least three defined output conditions.

3. The apparatus of claim 2 wherein the aggregate determinant signal is a sum of numerical values assigned to the output conditions of the first and second determinant signals.

4. The apparatus of claim 3 wherein the speech decision logic is configured for comparing the aggregate determinant signal with a defined value indicating the presence of speech in the communication signal and for asserting the logical output signal to indicate a result of the comparison.

5. The apparatus of claim 4 wherein the speech decision logic is configured for comparing the aggregate determinant signal with a second defined value indicating the absence of speech in the communication signal and for de-asserting the logical output signal to indicate a result of the comparison.

6. The apparatus of claim 5 wherein the speech decision logic is configured for comparing the aggregate determinant signal with a third defined value that the presence or absence of speech in the communication signal is indeterminate, and for maintaining the logical output signal in its most recent condition.

7. The apparatus of claim 4 wherein the second filter is operatively connected to receive the logical output signal, and is configured to vary the second statistical signal when the logical output signal indicates an absence of speech in the communication signal.

8. The apparatus of claim 7, further comprising a peak detector connected with the input terminal and configured for detecting peaks in the communication signal and providing a peak detection signal indicating the detection of a peak; and wherein the first filter is connected to receive the peak detection signal, and is configured to enable variation of the first statistical signal when a peak is detected.

9. The apparatus of claim 8 wherein the first and second filters are each selected from a group consisting of a moving average filter and a variance filter.

10. The apparatus of claim 9 wherein the peak detector is configured to provide a peak signal derived from the communication signal, and wherein the first and second filters are connected to receive the peak signal for producing the first and second statistical signals.

11. The apparatus of claim 10 wherein the first filter comprises a moving average filter for providing the first statistical signal as a moving average of the peak signal, and wherein the first comparison means comprises means for comparing the first statistical signal with at least two threshold levels for establishing the at least three output conditions of the first determinant signal.

12. The apparatus of claim 11 wherein the second filter comprises a moving average filter for providing the second statistical signal as a moving average of a portion of the peak signal coinciding with the logical output signal indicating an absence of speech, and wherein the second comparison means comprises means for comparing the second statistical signal with the first statistical signal in accordance with two threshold levels for establishing the at least three output conditions of the second determinant signal.

13. The apparatus of claim 1, comprising:

a third filter connected with the input terminal for providing a third statistical signal representing a third statistical value derived from the communication signal;

third comparison means for comparing the third statistical signal with a third reference signal indicative of the presence of speech in the communication signal, and for producing a third determinant signal representing the result of the comparison; and said speech decision logic is further configured for combining the first, second and third determinant signals to produce the aggregate determinant signal.

14. The apparatus of claim 13 wherein the first, second, and third comparison means are configured for comparing the respective first, second, and third statistical signals with respective first, second and third pairs of threshold signals for establishing at least three output conditions of each of said first, second, and third determinant signals.

15. The apparatus of claim 14, comprising threshold adjust logic operatively connected to receive the logical output signal and for adjusting a reference signal associated with one of said comparison means when the corresponding determinant signal is indicative of an output condition conflicting with the logical output signal provided by the speech decision logic.

16. The apparatus of claim 15 wherein said three output conditions comprise a first condition indicative of the presence of speech in the communication signal, a second condition indicative of the absence of speech in the communication signal, and a third condition indicating that the presence or absence of speech in the communication signal is indeterminate; and said threshold adjust logic is configured for incrementally adjusting said reference signal until the corresponding determinant signal assumes the third condition or ceases to conflict with the logical output signal.

17. The apparatus of claim 2, comprising dynamic adjustment means responsive to the logical output signal for establishing a plurality of threshold signals defining said first and second reference signals and for adjusting at least one of said threshold signals when the corresponding determinant signal is indicative of an output condition conflicting with the logical output signal.

18. The apparatus of claim 17 wherein said three output conditions comprise (i) a first condition indicative of the presence of speech in the communication signal, (ii) a second condition indicative of the absence of speech in the communication signal, and (iii) a third condition indicating that the presence or absence of speech in the communication signal is indeterminate; and said dynamic adjustment means is configured for incrementally adjusting said threshold signal until the corresponding determinant signal assumes the third condition or ceases to conflict with the logical output signal.

19. A speech detection system for detecting the presence of speech in a communication signal, comprising:

an input terminal for receiving the communication signal;

a plurality of speech detection modules connected to receive the communication signal, each speech detection module being configured to produce a soft determinant signal indicating a relative presence or absence of speech in the communication signal on the basis of a statistical criterion that is independent relative to the other speech detection modules;

speech decision logic for receiving the soft determinant signals, for adding the soft determinant signals to produce an aggregate determinant value, and for making a determination whether the aggregate determinant value is indicative of the presence or absence of speech in the communication signal; and an output terminal for providing a logical control signal on the basis of the determination made by the speech decision logic.

20. The apparatus of claim 19 wherein said plurality of speech detection modules comprises a 1st module having a moving average peak signal filter, a moving 2nd module having a average peak noise filter, and a 3rd module having a variance filter; and each of said modules further comprises comparison means for comparing an output signal of its associated filter with at least two threshold levels for producing the soft determinant signal.

21. The apparatus of claim 20 further comprising dynamic threshold adjustment means for adjusting one of said threshold levels in response to a conflicting speech/non-speech condition between one of the speech detection modules and the speech decision logic means.

22. The apparatus of claim 19 wherein each soft determinant signal is indicative of at least three conditions defined as the presence of noise, the presence of speech, and an indeterminate condition.

23. The apparatus of claim 22 wherein each of said speech detection modules is arranged to produce its soft determinant signal by comprising a statistical value derived from the communication signal with at least two threshold levels.

24. The apparatus of claim 23 further comprising threshold adjustment means for varying one of said threshold levels in response to a conflict between the logical control signal and the condition determined by any one of the speech detection modules.

25. The apparatus of claim 24 wherein said threshold adjustment means is configured for adjusting said one threshold level so that the corresponding speech detection module tends toward producing said soft determinant in a condition indicating an indeterminate signal condition.

* * * * *